US010145068B2

(12) United States Patent
Hans et al.

(10) Patent No.: US 10,145,068 B2
(45) Date of Patent: Dec. 4, 2018

(54) PROCESS FOR PRODUCING AT LEAST ONE PLY OF A PAPER OR BOARD AND A PAPER OR BOARD PRODUCED ACCORDING TO THE PROCESS

(71) Applicant: Stora Enso OYJ, Helsinki (FI)

(72) Inventors: Hallgren Hans, Bromma (SE); Frank Peng, Hammarö (SE); Anders Moberg, Hammaro (SE); Hans Höglund, Matfors (SE); Gunilla Pettersson, Sundsvall (SE); Sven Norgren, Sundsvall (SE)

(73) Assignee: Stora Enso OYJ, Helsinki (FI)

( * ) Notice: Subject to any disclaimer, the term of this patent is extended or adjusted under 35 U.S.C. 154(b) by 0 days.

(21) Appl. No.: 15/307,485

(22) PCT Filed: Apr. 29, 2015

(86) PCT No.: PCT/IB2015/053106
§ 371 (c)(1),
(2) Date: Oct. 28, 2016

(87) PCT Pub. No.: WO2015/166426
PCT Pub. Date: Nov. 5, 2015

(65) Prior Publication Data

US 2017/0051456 A1 Feb. 23, 2017

(30) Foreign Application Priority Data

Apr. 29, 2014 (SE) ..... 1450509

(51) Int. Cl.
*D21F 3/02* (2006.01)
*D21H 11/08* (2006.01)
(Continued)

(52) U.S. Cl.
CPC ..... *D21H 21/18* (2013.01); *D21F 3/0281* (2013.01); *D21H 11/08* (2013.01); *D21H 11/10* (2013.01); *D21H 17/26* (2013.01); *D21H 17/29* (2013.01)

(58) Field of Classification Search
CPC ..... D21H 11/08; D21H 11/02; D21H 11/10; D21H 17/26; D21H 17/29; D21H 21/18;
(Continued)

(56) References Cited

U.S. PATENT DOCUMENTS 3,905,864 A 9/1975 Curry et al.
3,954,554 A 5/1976 Curry et al.
(Continued)

FOREIGN PATENT DOCUMENTS

CN 1163643 A 10/1997
CN 1429302 A 7/2003
(Continued)

OTHER PUBLICATIONS

European Patent Office, International Search Report for PCT/IB2015/053106, dated Aug. 12, 2015.
(Continued)

*Primary Examiner* — Jose A Fortuna
(74) *Attorney, Agent, or Firm* — Greer, Burns & Crain Ltd.

(57) ABSTRACT

The present invention relates to a process for producing at least one ply of a paper or board product wherein a web comprising mechanical and/or chemimechanical pulp and at least one dry strength additive is dried in a press drying process by subjecting the web to heat and an overpressure of above 40 kPa. The present invention also relates to a paper product, a paperboard product and a ply produced according to the process.

17 Claims, 3 Drawing Sheets

(51) Int. Cl.

| | |
|---|---|
| ***D21H 11/10*** | (2006.01) |
| ***D21H 17/26*** | (2006.01) |
| ***D21H 17/29*** | (2006.01) |
| ***D21H 21/18*** | (2006.01) |

(58) Field of Classification Search
CPC ..... D21F 11/00; D21F 3/0281; D21F 3/02; D21F 3/0209
See application file for complete search history.

(56) References Cited

U.S. PATENT DOCUMENTS

| | | | | |
|---|---|---|---|---|
| 4,046,622 | A | 9/1977 | Attwood et al. | |
| 4,347,100 | A | 8/1982 | Brucato | |
| 4,391,670 | A * | 7/1983 | Phillips | D21C 9/1073 162/12 |
| 4,718,982 | A | 1/1988 | Swenson et al. | |
| 5,061,346 | A | 10/1991 | Taggart et al. | |
| 5,080,758 | A * | 1/1992 | Horng | B32B 29/00 162/130 |
| 5,230,776 | A | 7/1993 | Andersson et al. | |
| 5,482,595 | A * | 1/1996 | Harrington, IV | D21H 21/10 162/168.3 |
| 6,090,242 | A * | 7/2000 | Drummond | C08F 8/34 162/158 |
| 6,287,423 | B1 * | 9/2001 | Drummond | C08F 8/34 162/158 |
| 6,322,667 | B1 * | 11/2001 | McCall | D21F 5/00 162/100 |
| 6,616,807 | B1 | 9/2003 | Dyllick-Brenzinger et al. | |
| 6,723,204 | B2 * | 4/2004 | Van Handel | C08L 3/08 162/164.1 |
| 7,897,011 | B2 * | 3/2011 | Peng | D21H 27/38 162/129 |
| 8,568,564 | B2 * | 10/2013 | Cordova | C08B 15/10 162/164.7 |
| 2003/0041988 | A1 | 3/2003 | Vihervaara et al. | |
| 2003/0188840 | A1 | 10/2003 | Van Handel et al. | |
| 2005/0241785 | A1 * | 11/2005 | Peng | D21B 1/021 162/72 |
| 2005/0251976 | A1 * | 11/2005 | Lipponen | D21F 3/0209 28/100 |
| 2008/0314536 | A1 * | 12/2008 | Peng | D21H 27/38 162/129 |
| 2017/0051456 | A1 * | 2/2017 | Hans | D21F 3/0281 |

FOREIGN PATENT DOCUMENTS

| | | | | |
|---|---|---|---|---|
| CN | 101553622 | A | 10/2009 | |
| CN | 102639788 | A | 8/2012 | |
| EP | 0047173 | A2 * | 3/1982 | D21F 3/02 |
| WO | 9923298 | | 5/1999 | |
| WO | 9923300 | | 5/1999 | |
| WO | 9923303 | | 5/1999 | |
| WO | 0202869 | | 1/2002 | |
| WO | WO-2004022842 | A1 * | 3/2004 | D21B 1/021 |
| WO | 2006120235 | | 11/2006 | |
| WO | 2007121981 | A1 | 11/2007 | |
| WO | 2012007363 | | 1/2012 | |
| WO | 2012042115 | | 4/2012 | |
| WO | WO-2015166426 | A1 * | 11/2015 | D21F 3/0281 |

OTHER PUBLICATIONS

"Method-Rapid-Köthen sheet forming of laboratory hand sheets", PDF-document supplied by Product Testing Apparatus, 27 Beaconsfield Road, Sittingbourne, Kent, ME10 3BD U.K.

* cited by examiner

PROCESS FOR PRODUCING AT LEAST ONE PLY OF A PAPER OR BOARD AND A PAPER OR BOARD PRODUCED ACCORDING TO THE PROCESS

This application is a U.S. National Stage under 35 U.S.C. § 371 of International Application No. PCT/IB2015/053106, filed Apr. 29, 2015, which claims priority to Swedish Application No. 1450509-3 filed Apr. 29, 2014.

The present invention relates to a process for producing at least one ply of a paper or board product wherein a web comprising mechanical and/or chemimechanical pulp and at least one dry strength additive is dried in a press drying process by subjecting the web to heat and an overpressure of above 40 kPa. The present invention also relates to a paper product, a paperboard product and a ply produced according to the process.

BACKGROUND OF THE INVENTION

In paper and paperboard making processes there is a desire to obtain strong products with high bulk (low density). Paper and paperboard products having high bulk require less fiber amounts, which is desirable especially for economical reasons. Also, bulky paperboard products with low fiber content have a better bending stiffness which also is desirable. Paper and paperboard products are typically produced by dewatering furnish on a wire. The furnish often contains a mixture of different pulps, including both chemical pulps, mechanical and/or chemimechanical (CTMP) pulps. In order to produce a bulkier sheet with higher structural stiffness the interest in using mechanical or CTMP pulps with high freeness has increased. To obtain the best result the mechanical or CTMP pulp should contain long, intact fibers and as little fine material as possible. However, pulps that are rich in stiff, long fibers unfortunately show poor ability to produce sufficient fiber bonding of the paper or board. The bulk and strength properties of the resulting paper or board will therefore be a compromise between the ability of the pulp to increase the bulk and its ability to increase the fiber bonding properties of the paper or board.

The fiber bonding properties of mechanical or CTMP pulps may also be improved by treatment with chemical additives. The predominant treatment for improving strength, particularly dry strength, of paper or board has so far been to add cationic starch to the pulp fiber slurry prior to the sheet forming operation. It is however difficult to adsorb large amounts of starch to the fibers, especially when the fines amount is small. One way to increase the amount of starch retained in a paper or paperboard products is to treat the fibers with polymers in several steps as is described in WO0032702 A1 and WO 2006041401 A1.

However, there is still a need for a method for producing paper or paperboard, which has an improved strength without negatively affecting the bulk.

SUMMARY OF THE INVENTION

The object of the invention is to provide a method for producing a paper or board product, which has an improved strength, without adversely affecting the bulk.

This object, and other advantages, are achieved by the process according to claim 1. It has now been found that by drying a web comprising cellulosic fibers and at least one dry strength additive in press drying process a surprisingly strong but yet bulky product can be produced. The above object is thus achieved by the present invention as defined by the appended independent claims. Preferred embodiments are set forth in the dependent claims and in the following description.

The present invention relates to a process for producing at least one ply of a paper or paperboard product, which process comprises the steps of: providing a furnish comprising mechanical and/or chemimechanical pulp; adding at least one dry strength additive to the furnish, dewatering the furnish on a wire to form a fiber web and drying the web in a press drying process by subjecting the web to heat and an overpressure of above 40 kPa. It has been found that by drying a web comprising mechanical and/or chemimechanical pulp and at least one dry strength additive in a press drying process, i.e. by subjecting the web to an overpressure of above 40 kPa and heat, a strong but yet bulky product can be produced. It has been found that drying a web comprising mechanical and/or chemimechanical pulp according to the invention tend to even further increase the strength of the product without adversely affecting the bulk.

The overpressure in the press drying process is preferably above 80 kPa. The temperature of the web during the press drying process is preferably between 60-160° C.

The dry content of the web being dried in the press drying process is preferably between 40-80% by weight. It has been found that the increase of the strength of the product is improved if the dry content of the web to be dried press drying process is between 40-80% by weight.

It may be preferred to add at least two different dry strength additives, a first and a second dry strength additive, to the furnish. The at least two additives may be added separately to the furnish or premixed. The first dry strength additive is preferably cationic starch and the second dry strength additive is preferably carboxymethyl cellulose (CMC). If cationic starch is added as at least one dry strength additive it may be preferred to add cationic starch in an amount of between 10-50 kg/ton fiber.

The present invention also relates to a paper product comprising at least one ply produced according to the process described herein. By the use of the present process it is possible to produce a very strong paper product comprising mechanical pulp and/or chemimechanical pulp. The paper product may preferably comprise at least 70% mechanical and/or chemimechanical pulp and it has a tensile index of above 60 Nm/g (geometric mean (GM) value), a SCT index of above 25 Nm/g (GM value) and/or a tensile stiffness index of above 6 kNm/g (GM value).

The present invention also relates to a paperboard product comprising at least one ply produced according to the process described herein. It may be preferred that the paperboard product comprises three plies and the at least one ply produced according to claim 1 forms the middle ply of the paperboard product. By the use of the present process it is possible to produce a very strong and bulky paperboard product.

The paper product may preferably comprise at least 70% mechanical and/or chemimechanical pulp and it has a density below 600 kg/m$^3$ and a tensile index of above 60 Nm/g (geometric mean (GM) value), a SCT index of above 25 Nm/g (GM value) and/or a tensile stiffness index of above 6 kNm/g (GM value). The paper product is then suitable for a paperboard product. It is surprisingly that such high strength values can be achieved at a relatively low density.

The paper product may preferably comprise at least 70% mechanical and/or chemimechanical pulp and it has a density below 800 kg/m$^3$ and a tensile index of above 75 Nm/g (geometric mean (GM) value), a SCT index of above 30 Nm/g (GM value) and/or a tensile stiffness index of above 7 kNm/g (GM value). The paper product can then preferably be used as a liner. It is surprisingly that such high strength values can be achieved at densities below 800 kg/m$^3$, preferably below 750 kg/m$^3$.

The present invention also relates to a ply of a paper or paperboard product produced according to the process described herein wherein the ply comprises at least 70% mechanical and/or chemimechanical pulp and the ply has a density (D) and a z-strength (z) that correlates according to the formula: $z=1.82\times D-400+m$ wherein m is ≥0 and the ply has a density (D) of above 275 kg/m$^3$.

SHORT DESCRIPTION OF THE DRAWINGS

DETAILED DESCRIPTION OF THE INVENTION

Figure 1:
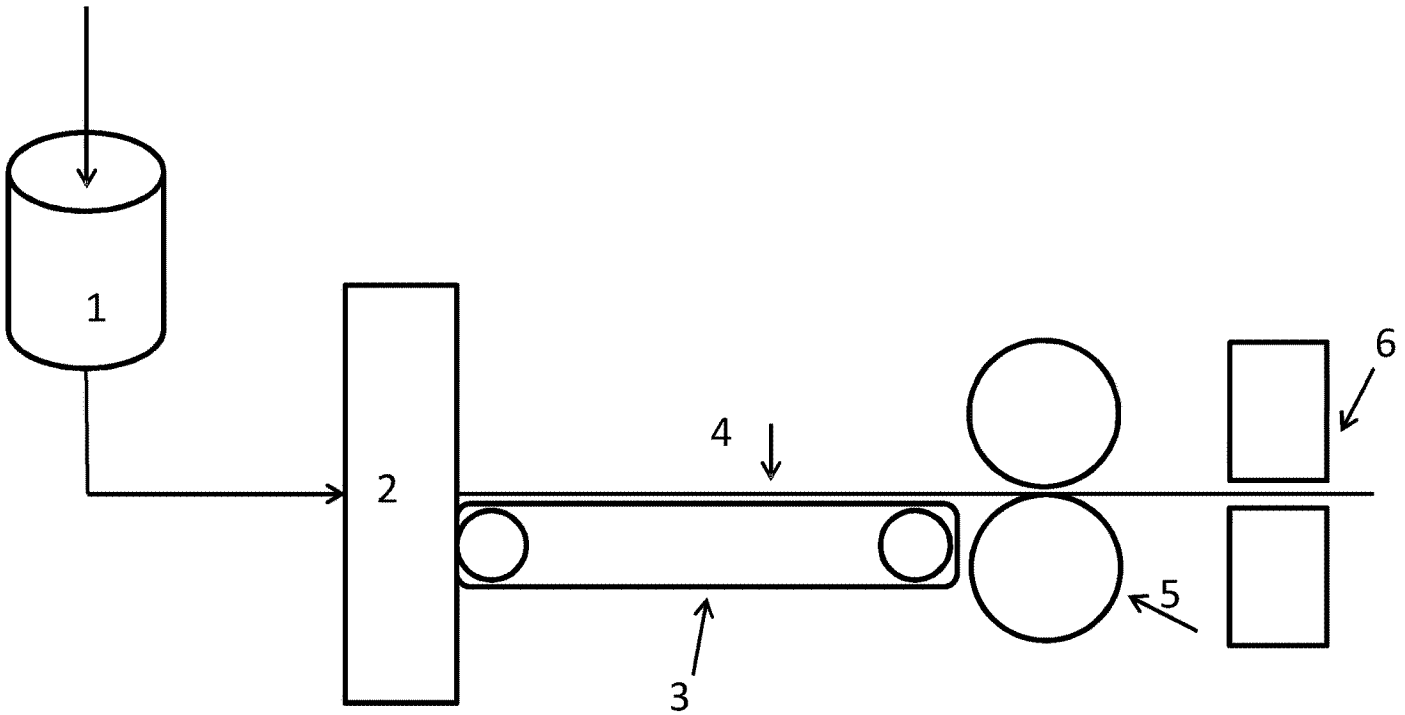
FIG. 1 is a schematic view of one embodiment of the process of the present invention.

The invention relates to a process for producing at least one ply of a paper or paperboard product from a furnish comprising mechanical and/or chemimechanical pulp by adding at least one strength additive to the furnish, dewatering the furnish to form a web and thereafter drying the web in a press drying process by subjecting the web to heat and an overpressure of above 40 kPa. Thus, after the web has been dried in the press drying process, the at least one ply of the paper or paperboard product is produced. The invention also relates to a paper or paperboard product produced according to the process of the present invention.

It has now been found that by subjecting a web comprising mechanical and/or chemimechanical pulp and at least one dry strength additive to a press drying process, the strength properties of the paper or paperboard product are surprisingly very good compared to if a web comprising no dry strength additives is subjected to a press drying process or if a web comprising at least one strength additive is dried by any other drying method. Even more surprisingly, the bulk of the paper or paperboard product is also very good as compared to paper or paperboard products produced by a different method.

The furnish comprises mechanical pulp or thermomechanical pulp (TMP) and/or chemimechanical pulp (CTMP). It has been found that the drying of a web comprising cellulosic fibers in the form of mechanical and/or chemimechanical pulp in a press drying process according to the invention tend to even further increase the strength of the product without adversely affecting the bulk. However, it may also be possible to that the furnish comprises chemical pulp, such as kraft pulp or sulfite pulp. It has also been shown that the combination of chemimechanical pulp (CTMP) and chemical pulp may be advantageous when using the press drying process. The pulp may preferably have a freeness of above 150 CSF, preferably above 200 CSF, measured according to ISO 5267-2:2001.

The cellulosic fibers may be of any kind of cellulosic fibers i.e. both hardwood and soft wood fibers. Examples of hardwood fibers that can be used are birch, *eucalyptus*, and/or aspen. Examples of softwood fibers that can be used are spruce and/or pine.

The overpressure applied during the press drying process is above 40 kPa, preferably above 80 kPa, even more preferably above 100 kPa. The overpressure may be between 40-10000 kPa, preferably between 80-5000 kPa. The temperature of the web during the press drying process may be between 60-160° C. The optimal temperature, pressure and dwell time of the press drying process depends on the product being produced and the desired qualities of the product. Any kind of processes combining heat and an overpressure above 40 kPa known in art can be used, examples of possible equipment to be used in a press drying process are; Condebelt, Boost dryer, breaker stack or hot pressing.

The dry content of the web being dried in the press drying process is preferably between 40-80% by weight. It has been found that the increase of the strength of the product is strongly improved if the dry content of the web to be dried in the press drying process is between 40-80% by weight. The reason to why it seems to work so well at these specific dry contents are not completely understood. One theory is that there is an optimal water amount of the web being dried in order for the fibers and the additives of the furnish to connect or bond which will make the product much stronger. Too much water will deteriorate the connections between the fibers and the additives and too little water will make the fibers more stiff which also will deteriorate any connections. The dry content of the web after the press drying process is preferably above 80%.

It may be possible to press the web using any known pressing equipment. The pressing is preferably done before the web is conducted to the press drying process. The dry content of the web before pressing may be between 20-25%, the dry content of the web after the pressing may be between 40-50%.

It may be preferred to add at least two different dry strength additives, a first and a second dry strength additive, to the furnish. The at least two additives may be added separately to the furnish. However, it may also be possible to mix the two additives prior to addition to the furnish. It may also be possible to add more than two dry strength additives to the furnish, e.g. three, four, five, six or seven different dry strength additives.

It may be preferred that the first dry strength additive and the second dry strength additive are interacting with each other. The first dry strength additive is preferably cationic starch and the second dry strength additive is preferably carboxymethyl cellulose (CMC). The use of the combination of cationic starch and CMC is known to increase the dry strength of a paper or paperboard product due to that larger amounts of the additives are remained in the furnish, for example by being attached to the fibers. It has now been shown that combination of cationic starch and CMC with the press drying process shows very good results. The amount of dry strength additive to be added varies depending of the properties of the pulp.

When cationic starch are added the amount of cationic starch added to the furnish is preferably between 10-40 kg/ton fiber, preferably above 15 kg/ton fiber and even more preferably between 20-40 kg/ton fiber. When carboxymethyl cellulose is used the amount of CMC added to the furnish is preferably between 0.5-5 kg/ton fiber, preferably above 1 kg/ton fiber and even more preferably between 2-4 kg/ton fiber.

A dry strength additive is an additive that either alone or in combination with another additive improves the dry strength of the paper or paperboard product. Possible dry strength additives to be used could be, but not limited to, one or more additives chosen from the group consisting of: carboxy methyl cellulose (CMC), guar gum, polyvinyl sulphate, anionic galactoglucomannan, starch (cationic or anionic), polyphosphoric acid, alginate, polymethacrylic acid, polyvinyl amine, chitosan, primary and secondary amines, polyethylene imines, polyvinyl pyrrolidone and/or modified polyacryl amides.

The furnish may also comprise other additives such as fillers and other paper making additives, e.g. sizing agents and wet strength agents.

The at least one ply of the paper or paperboard product produced according to the process described herein may comprise two, three, four or even more plies, i.e. it is possible to produce a multiply product by the process. This can for example be done by the use of a multilayer head box that conducts the furnish (same or different furnish compositions in each layer) to a wire wherein the furnish forms a web. The multiply web is thereafter dried in the press drying process according to the invention. The present invention also relates to a paper product comprising the at least one ply produced according to the process described herein. The paper product preferably comprises at least 70% mechanical and/or chemimechanical pulp and has a density below 600 kg/m$^3$ and it has a tensile index of above 60 Nm/g (GM value), preferably above 70 Nm/g (GM value), a SCT index of above 25 Nm/g (GM value) and/or a tensile stiffness index of above 6 kNm/g (GM value). It may be preferred that the paper product has a density below 800 kg/m$^3$, preferably below 750 kg/m$^3$ and that the paper then has a tensile index of above 75 Nm/g (geometric mean (GM) value), preferably above 80 Nm/g (GM value), a SCT index of above 30 Nm/g (GM value), preferably above 35 Nm/g (GM value) and/or a tensile stiffness index of above 7 kNm/g (GM value), preferably above 7 kNm/g (GM value). The paper product is then preferably used as a liner. The density is measured according to ISO 534:2005, the tensile index is measured according to ISO1924-3:2005, the SCT index is measured according to ISO 9895:2008 and the tensile stiffness index is measured according to ISO 1924-2:2008.

By the use of the present process it is thus possible to produce a very strong paper product. The paper may for example be used as a liner board or other kraft papers e.g. sack paper. The paper preferably comprises one ply. However, the paper product may also comprise more than one ply, e.g two, three or more plies, formed separately or by means of a multilayer head box. It is possible that the paper product comprises at least one ply produced according to the process described herein and another ply or plies produced in another way. It is also possible that the paper product comprises more than one plies produced according to the process described herein. The paper product may be coated by any conventional known method in order to improve the printability of the product, thus a strong product with good printability may be produced.

The present invention also relates to a paperboard product comprising the at least one ply produced according to the process described herein. By producing a paperboard product by the use of the present invention a strong but yet very good bulky product can be produced. The paperboard may preferably comprise at least three plies and it is preferred that the at least one ply produced according to the present process forms at least one of the middle plies of the product. The paperboard product may comprise four, five, six, seven or even more plies. The outermost plies of the product, i.e. the top ply and the bottom ply may also be produced by the process according to the invention, i.e. it is possible that all plies of the product are produced according to the present invention. The paperboard may be coated or polymer laminated in order to produce paperboard suitable for different end uses, such as folding box board, food service board, cigarette board and/or liquid packaging board.

The present invention also relates to a ply of a paper or paperboard product produced according to the process described above wherein the ply comprises at least 70% mechanical and/or chemimechanical pulp and the ply has a density (D) and a z-strength (z) that correlates according to the formula: $z=1.82\times D-400+m$ wherein m is $\geq 0$ and the ply has a density (D) of above 275 kg/m$^3$. The z-strength was measured according to SCAN-P 80:98 and the density according to ISO 534:2005.

It has surprisingly been found that mechanical and/or chemimechanical pulps can be used in order to produce a ply of a paperboard product having similar strength to a ply comprising chemical pulp, even though the bulk is much higher. Thus, the product according to the invention can thus be produced in a much more economical way.

FIG. 1 is a schematic description of the process according to one embodiment of the invention. In this embodiment a furnish for production of a paper or paperboard product is transferred to a pulp chest (1). To the furnish in the pulp chest (1) a first and a second dry strength agent are added. The furnish is thereafter mixed in the pulp chest (1) in order to ensure that the added dry strength additive is well blended with the furnish. The furnish is thereafter conducted from the pulp chest (1) to the headbox (2) and further to a wire (3) where the furnish is dewatered in order to form a web (4). The web (4) is thereafter conducted to a press section (5) where the dry content of the web (4) is increased to about 40-50% by weight. The web (4) is thereafter conducted to the press drying process (6) where the web is subjected to heat and an overpressure of above 40 kPa and at least one ply of the paper or paperboard product is formed.

EXAMPLE 1

Spruce CTMP pulps were treated in different ways to show the advantages of the present invention. The samples were prepared according to Table 1.

TABLE 1

| Sample preparation | | |
|---|---|---|
| | Dry Strength Additive | Drying method |
| Series A | No | Without pressure |
| Series B | Yes | Without pressure |
| Series C | No | Under pressure |
| Series D | Yes | Under pressure |

Series A consists of spruce CTMPs with different freeness and with 0-30% bleached sulphate kraft pulp (BSKP) in the pulp furnish. Sheet forming was done with the known technique Formette Dynamique. The sheet dryness after wet pressing was about 60% by weight, and the sheets were thereafter dried restrained without any contact pressure.

Series B consists of spruce CTMPs with different freeness and with 0-15% BSKP in the pulp furnish, and the addition of DSA. Sheet forming was done with Formette Dynamique. The sheet dryness after wet pressing was about 60%, and the sheets were thereafter dried restrained without any contact pressure.

Series C consists of the same kind of spruce CTMP (no BSKP). Sheet forming was done with Rapid Köthen. Drying was carried out under given contact pressure and temperature to different dryness levels and the sheets were thereafter dried without any contact pressure to 100% dryness.

Series D is the same as Series C but with the addition of DSA.

The dry strength additives (DSA) used were Starch Pearl Bond 930 with a cationic degree of substitution of 0.04 from Lyckeby Starch, which was added to the pulp in an amount of 40 kg/ton fiber, and carboxymethyl cellulose (CMC) FinnFix30 from CP-Kelco, which was added to the pulp in an amount of 2 kg/ton fiber. The dry strength additives were added to the pulp, series B and D.

A Rapid Köthen equipment (PTI, Vorchdorf, Austria) was used in order to prepare and dry the sheets in Series C and D, i.e. a press drying process according to the invention. CTMP suspension with a dry content of about 0.6% by weight was used for the preparation of sheets with a grammage of about 150 g/m$^2$ using the Rapid Köthen equipment. The formed sheets were thereafter dried at 93° C. at an overpressure of 95 kPa Drying was carried out under the given contact pressure and temperature to different dryness levels and thereafter dried without contact pressure. The samples with the highest strength and densities were only subjected to the press drying process, while the other samples in the series were partly subjected to the press drying process and party to standard drying technology, i.e. without being subjected to an overpressure.

The density and the z-strength were measured on the dried sheets. The z-strength was measured according to SCAN-P 80:98 and the density according to ISO 534:2005.

Figure 2:
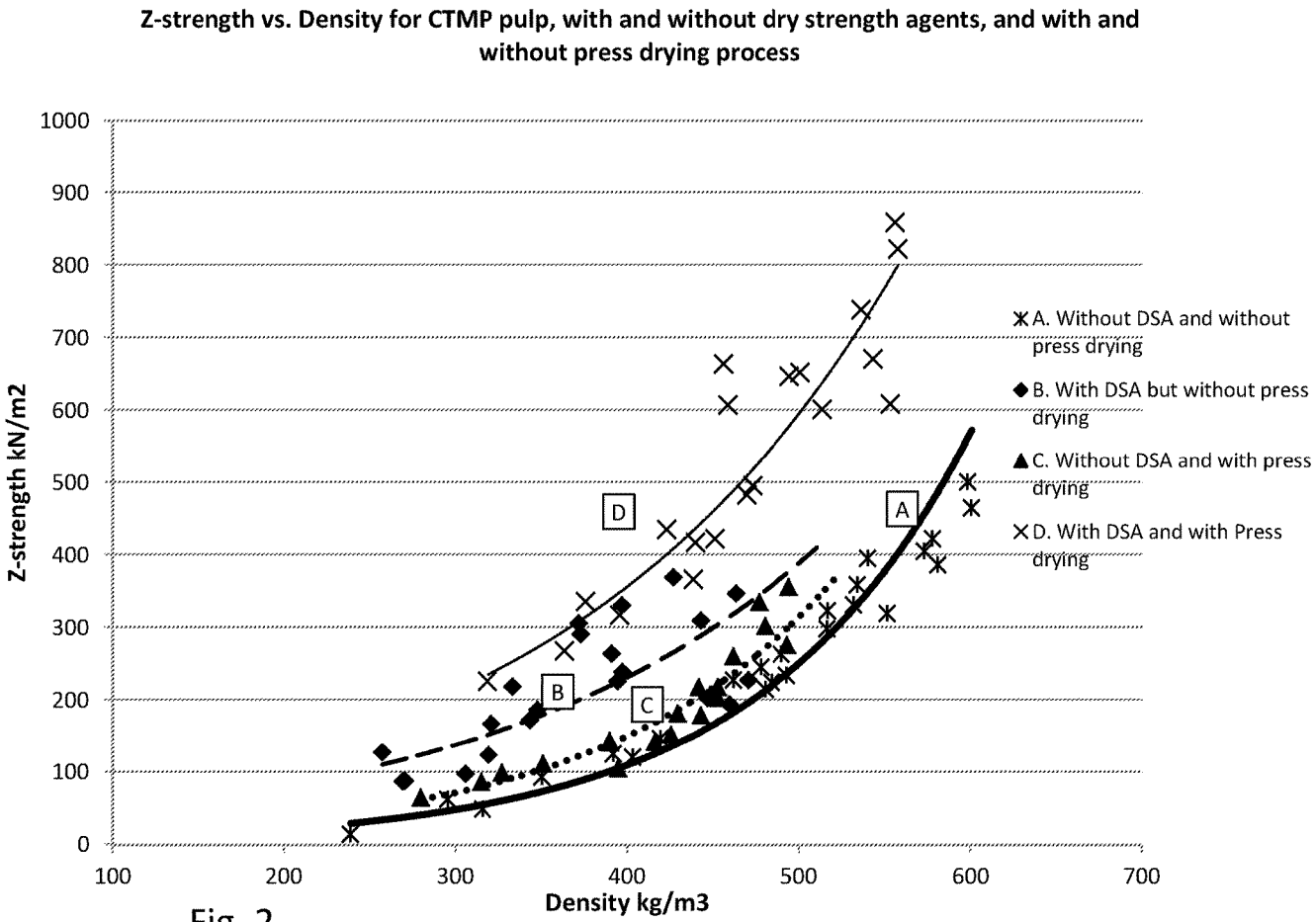
FIG. 2 is a diagram which shows the density and z-strength of products produced according to the present invention and products produced according to prior art processes.

The results on z-strength and density are shown in FIG. 2. It is clear from FIG. 2 that there is an intrinsic correlation between z-strength and density despite the variation in furnish composition, as shown in series A and B. Applying press drying alone without DSA (series C) improves only marginally the z-strength at given density as compared to series A. Adding DSA in the furnish (series B) without press drying results in significantly improved z-strength at given density. However, the samples being treated according to the present invention, i.e. series D, have much higher z-strength at given density value compared to the other series. It is thus shown that it is possible to produce a strong but yet bulky product by the combination of addition of wet strength additives and the press drying process as described by the present invention.

sulfate pulp (BSKP) refined to 25 SR, were produced in a Rapid Köthen sheet former and dried to a solid content of 40%. Corresponding values from ISO lab sheets for the individual components are shown in table 2. From the individual density and tensile properties the weighted arithmetic average values for a mixture of 80% CTMP and 20% BSKP is calculated. For density the inverted values are used for the weighted average calculation.

TABLE 2

| Pulp component data ISO Sheets | | | |
|---|---|---|---|
| | Freeness/SR | Tensile index | Density |
| CTMP 210 | 216 | 50.6 | 522 |
| CTMP 470 | 466 | 34.5 | 413 |
| BSKP 25 | 25 | 85 | 730 |

Figure 3:
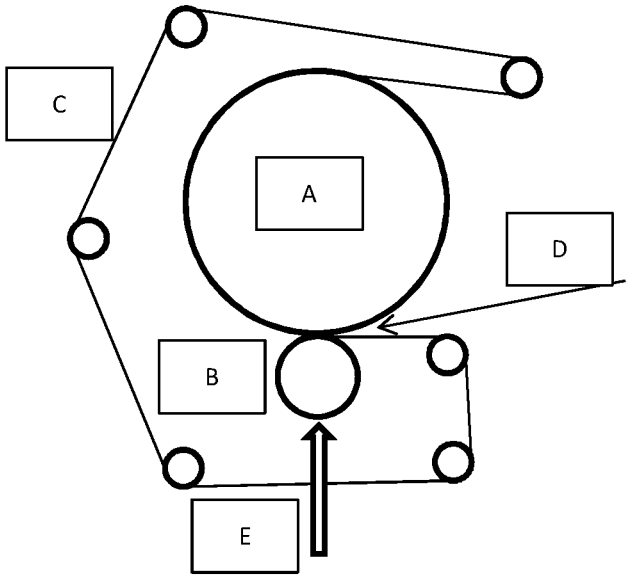
FIG. 3 is a schematic view of the press drying equipment used in Example 2.

The sheets were fed onto a single drying cylinder equipped with a felted press nip as described in FIG. 3. FIG. 3 shows the press drying equipment used where (A) is a heated cylinder and (B) is a press roll and pressure is applied by (B) in the direction of the arrow (E). Thus, cylinder (A) and press roll (B) forms a nip. Between said nip is a dryer felt (C) fed. The sheets to be dried are fed to the equipment as indicated by arrow D, i.e. to the felt (C) being conducted in between cylinder (A) and press roll (B).

Two CTMP furnishes were tested, 210 ml CSF and 450 ml CSF and two cylinder temperatures 25° C. respectively 100° C. were used, and a line load 90 kN/m in the press was applied. This correspond to a specific pressure of ~6000 kPa(e) at a nip width of ~15 mm. The sheets that were pressed at 25° C. were thereafter fed into the dryer a second time without applied press load for final drying of the sheets. The sheets running at 100° C. reached full dryness during the first loop of press drying. Dry strength additives were added to the laboratory sheets at a level 50 kg/ton of cationic starch and 4 kg/ton of CMC.

TABLE 3

| Results from the sheets dried in the equipment in FIG. 3. | | | | | | | | | |
|---|---|---|---|---|---|---|---|---|---|
| | | Mixture of 80% CTMP and 20% BSKP | | | | | | | |
| | | CTMP216 + BSKP25 | CTMP216 + BSKP25 Press 90 kN/m | | | CTMP466 + BSKP25 | CTMP466 + BSKP25 Press 90 kN/m | | |
| | | Calculated values based on ISO sheets | w/o DSA No heat cyl 25° C. | w/o DSA Heated cyl 100° C. | with DSA Heated cyl 100° C. | Calculated values based on ISO sheets | w/o DSA No heat cyl 25° C. | w/o DSA Heated cyl 100° C. | with DSA Heated cyl 100° C. |
| Density | kg/m3 | 553.5 | 583 | 696 | 734 | 452 | 566 | 614 | 629 |
| Tensile index | Nm/g | 57.5 | 59.2 | 64.1 | 85.6 | 44.6 | 51.6 | 62.7 | 79.4 |
| SCT index | Nm/g | No data | 29.4 | 32.2 | 37.9 | No data | 26.6 | 29.4 | 34.4 |
| Tensile stiffness index | kNm/g | No data | 6.24 | 6.67 | 7.95 | No data | 5.92 | 7.04 | 7.5 |

EXAMPLE 2

Laboratory sheets, based on a mixture of 80% spruce CTMP, 210 and 470 ml freesness and 20% bleched softwood The results show a significant increase in tensile strength index, SCT and Tensile stiffness index when press drying was applied together with addition of dry strength additives, see table 3.

In view of the above detailed description of the present invention, other modifications and variations will become apparent to those skilled in the art. However, it should be apparent that such other modifications and variations may be effected without departing from the spirit and scope of the invention.

The invention claimed is:

1. A process for producing at least one ply of a paper or paperboard product, which process comprises the steps of:

providing a furnish comprising at least 70% mechanical and/or chemimechanical pulp;

adding at least two different dry strength additives, a first and a second dry strength additive, to the furnish, dewatering the furnish on a wire to form a fiber web; and drying the web in a press drying process by subjecting the web to heat and a contact pressure above 40 kPa; and wherein the press dried web has a density below 800kg/m $^3$.

2. The process according to claim 1 wherein the contact pressure in the press drying process is above 80 kPa.

3. The process according claim 1 wherein the temperature of the surface of the web during the press drying process is between 60-160° C.

4. The process according claim 1 wherein the dry content of the web being dried in the press drying process is between 40-80% by weight.

5. The process according to claim 1 wherein the first dry strength additive is cationic starch and the second dry strength additive is carboxymethyl cellulose (CMC).

6. The process according to claim 1 wherein one of the dry strength additives is cationic starch that is added in an amount of between 10-50 kg/ton fiber.

7. The process according claim 1 wherein the at least two different dry strength additives are mixed prior to addition to the furnish.

8. The process according claim 1 wherein one of the dry strength additives is carboxymethyl cellulose (CMC) that is added in an amount of between 0.5-5 kg/ton fiber.

9. The process according claim 1 wherein the at least two different dry strength additives are selected from the group consisting of carboxymethyl cellulose (CMC), guar gum, polyvinyl sulphate, anionic galactoglucomannan, cationic or anionic starch, phosphoric acid, alginate, polymethacrylic acid, polyvinyl amine, chitosan, primary or secondary amines, polyethylene imines, polyvinyl pyrrolidone, or modified polyacryl amides, or combinations thereof.

10. The process according claim 1 further comprising coating the press dried web with a polymer or laminating the press dried web with a polymer.

11. The process according claim 1 further comprising pressing the dewatered web before drying the web in the press drying process.

12. The process according claim 11 wherein a dry content of the dewatered web is between 20-25% by weight.

13. The process according claim 11 wherein a dry content of the pressed web is between 40-50% by weight.

14. The process according claim 1 wherein a dry content of the press dried web is above 80% by weight.

15. A process for producing at least one ply of a paper or paperboard product, which process comprises the steps of:

providing a furnish comprising at least 70% mechanical and/or chemimechanical pulp;

adding at least two different dry strength additives, a first and a second dry strength additive, to the furnish and wherein wherein the first dry strength additive is cationic starch and the second dry strength additive is carboxymethyl cellulose (CMC), dewatering the furnish on a wire to form a fiber web; and drying the web in a press drying process by subjecting the web to heat and a contact pressure above 40 kPa, and wherein the temperature of the surface of the web during the press drying process is between 60-160° C.; and wherein the press dried web has a density below 800 kg/m $^3$.

16. The process according to claim 15 wherein the first dry strength additive is added in an amount of between 10-50 kg/ton fiber, and wherein the second dry strength additive is added in an amount of between 0.5-5 kg/ton fiber.

17. The process according claim 15 further comprising pressing the dewatered web before drying the web in the press drying process.

* * * * *